US005868445A

United States Patent [19]

Kaufman et al.

[11] Patent Number: 5,868,445

[45] **Date of Patent: *Feb. 9, 1999**

[54] MAGNETIC SLIDE LOCK ASSEMBLY

[76] Inventors: Eli Kaufman, 939 51st St., Brooklyn, N.Y. 11219; Irving Bauer, Rte. 4, Box Y23, Mount Kisco, N.Y. 10549

[ * ] Notice: The term of this patent shall not extend beyond the expiration date of Pat. No. 5,515,581.

[21] Appl. No.: 880,389

[22] Filed: Jun. 23, 1997

Related U.S. Application Data

[63] Continuation of Ser. No. 551,959, Nov. 2, 1995, abandoned.

[51] Int. Cl.[6] ..... E05C 17/56

[52] U.S. Cl. ..... 292/251.5; 292/42

[58] Field of Search ..... 24/303, 634, 635, 24/639, 648, 657; 292/42, 251.5, 302, 145, 146, 150, 106

[56] References Cited

U.S. PATENT DOCUMENTS

| | | | |
|---|---|---|---|
| 711,812 | 10/1902 | Armstrong | 24/657 |
| 2,453,021 | 11/1948 | Konelsky | 282/194 |
| 2,861,831 | 11/1958 | Loeb | 292/251.5 |
| 2,862,752 | 12/1958 | Heppner | 292/251.5 |
| 3,837,525 | 9/1974 | Kobayashi | 220/55 K |
| 4,021,891 | 5/1977 | Morita | 24/201 B |
| 4,458,395 | 7/1984 | Aoki | 24/303 |
| 4,468,843 | 9/1984 | Duclos et al. | 24/642 |
| 4,754,532 | 7/1988 | Thomson et al. | 24/303 |
| 4,867,491 | 9/1989 | Arnold | 292/150 |
| 5,199,138 | 4/1993 | Morita | 24/303 |
| 5,253,394 | 10/1993 | Morita | 24/303 |
| 5,377,392 | 1/1995 | Morita | 24/303 |
| 5,515,581 | 5/1996 | Kaufman | 24/300 |
| 5,572,772 | 11/1996 | Morita | 24/303 |

FOREIGN PATENT DOCUMENTS

| | | | |
|---|---|---|---|
| 472995 | 12/1914 | France | 24/657 |
| 444552 | 2/1968 | Switzerland | 42/657 |

*Primary Examiner*—Steven Meyers
*Assistant Examiner*—Gary Estremsky
*Attorney, Agent, or Firm*—Oblon, Spivak, McClelland, Maier & Neustadt, P.C.

[57] ABSTRACT

A magnetic slide lock assembly includes interconnecting male and female members and utilizes the attractive force of a magnet to interconnect the male and female members. The male member of the magnetic slide lock assembly can include a protruding member or housing with a magnet positioned therein. The protruding member includes an opening so as to expose a portion of the magnet. The female member can include a plate or plates which are slidable so as to come into engagement or out of engagement with the magnet. The magnetic slide lock assembly provides for a strong closure between the male and female members so as to resist a disengagement of the male and female members when a strong force is exerted on the lock assembly.

17 Claims, 8 Drawing Sheets

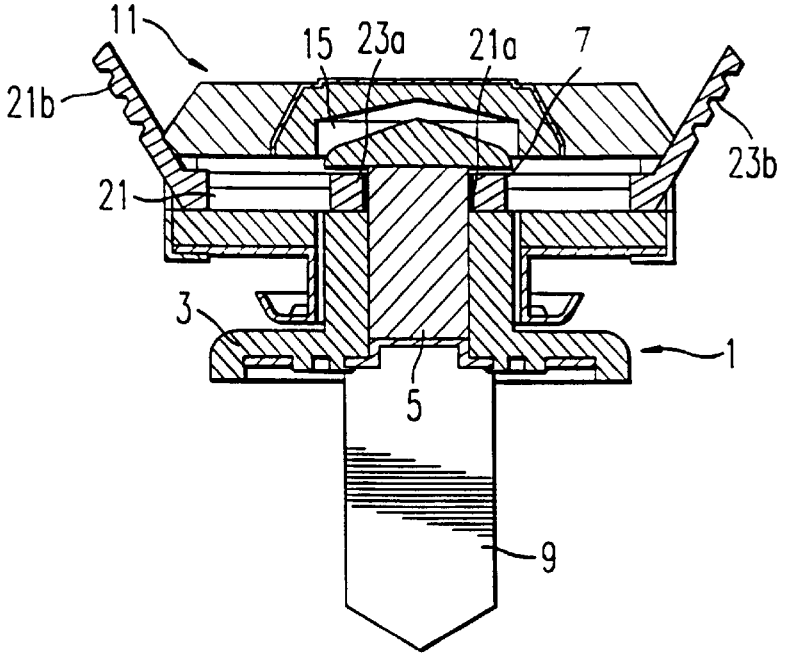
FIG. 1
FIG. 2
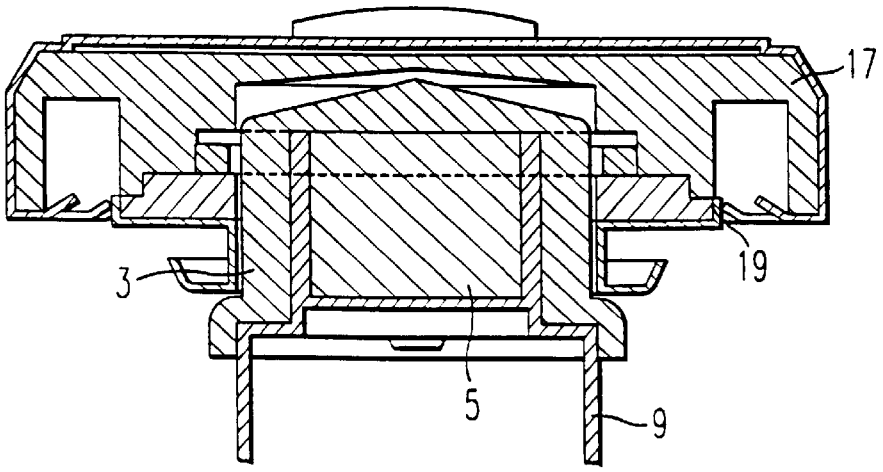

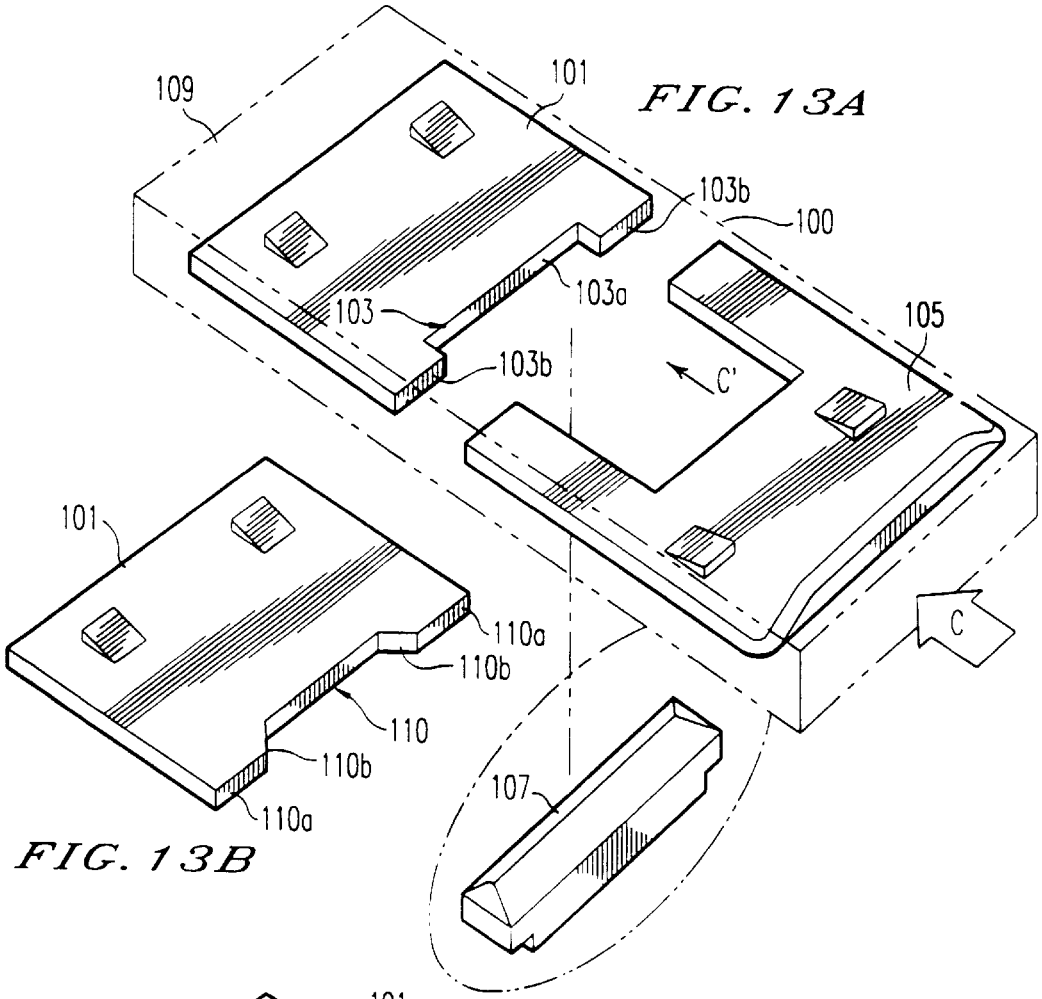
FIG. 13A
FIG. 13B
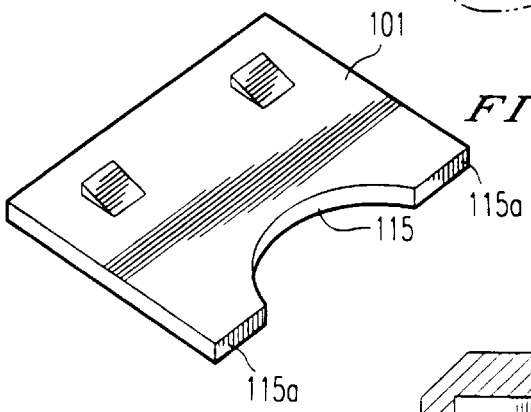
FIG. 13C
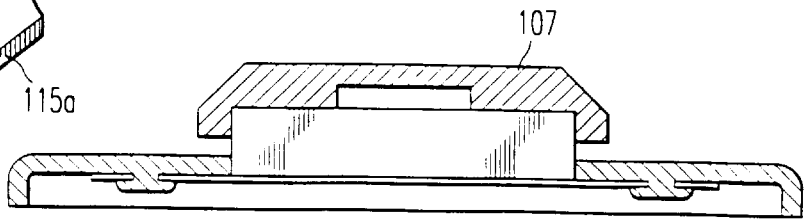
FIG. 14

MAGNETIC SLIDE LOCK ASSEMBLY

This application is a Continuation of application Ser. No. 08/551,959, filed on Nov. 2, 1995, now abandoned.

BACKGROUND OF THE INVENTION

1. Field of the Invention

The present invention relates to a magnetic slide lock assembly for various types of bags such as handbags, briefcases and backpacks, and for various types of boxes, belts and other types of fasteners used for keeping door-type structures either open or closed.

2. Discussion of the Related Art

Fastening devices which utilize the combination of interconnecting male and female members and the attractive force of a magnet are advantageous in that they are easy to use and the female member can be easily attracted to and detached from the male member. However, conventional fastening devices have drawbacks in that they do not provide for a sufficiently positive closure between the male and female members and thus, when a force or an impact stronger than the attraction force of the permanent magnet is exerted on either the male or female members, they become easily disengaged.

Additionally, it is difficult to mass-produce conventional fastening devices due to the fact that they tend to have a complicated structure and include a large number of component parts.

SUMMARY OF THE INVENTION

An object of the present invention is to provide for a magnetic slide lock assembly having a strong closure between the male and female members of the locking assembly to resist the disengagement of the male and female members when a strong force is exerted on the locking assembly.

A further object of the present invention is to provide for a magnetic slide lock assembly which is simple in construction and suitable for mass-production.

A further object of the present invention is to provide for a magnetic slide lock assembly which enables a rapid and accurate assembly of the component parts of the assembly by either a fully or partially automated process.

A further object of the present invention is to provide for a magnetic slide lock assembly which can be easily and efficiently attached to an article.

A further object of the present invention is to provide for a magnetic slide lock assembly in which the handle which is utilized for releasing the locking assembly from a locking state can be easily manufactured.

A further object of the present invention is to provide for a magnetic slide lock assembly which includes a basic locking structure that is inexpensive to produce and can be manufactured in several standard sizes.

The magnetic slide lock assembly of the present invention comprises a male member including a protruding member and a magnet positioned in the protruding member such that a portion of the magnet is exposed through first and second openings in the protruding member; a female member comprising first and second overlapping plates which are movable with respect to each other, the first and second overlapping plates defining an aperture for permitting the protruding member of the male member to be inserted therethrough, the first plate comprising a first magnetically attracting facing surface and the second plate comprising a second magnetically attracting facing surface, wherein when the protruding member is inserted through the aperture, the first magnetically attracting facing surface is attracted to one of the first and second openings of the protruding member so as to magnetically and mechanically engage with the exposed portion of the magnet through the one opening, and the second magnetically attracting facing surface is attracted to the other one of the first and second openings of the protruding member so as to magnetically and mechanically engage with the exposed portion of the magnet through the other one of the openings.

The present invention also provides for a magnetic slide lock assembly which comprises a male member comprising a protruding member and a magnet positioned within the protruding member, the protruding member comprising an opening for exposing a portion of the magnet; and a female member comprising a housing and a sliding member slidably positioned within the housing, the sliding member being substantially C-shaped and comprising a first surface which is attracted to the exposed portion of the magnet through the opening when the male member is inserted into the female member, to thereby magnetically and mechanically engage the male member to the female member.

The present invention also provides for a magnetic slide lock assembly which comprises a male member having a protruding member and a magnet positioned within the protruding member, the protruding member having an opening so as to expose a portion of the magnet; and a female member comprising an upper housing and a lower housing, an outer portion of the upper housing and a facing outer portion of the lower housing defining an opening therebetween which is sized to permit a portion of an article to be inserted and attached therein.

The present invention also provides for a magnetic slide lock assembly which comprises a male member having a magnetic portion, the magnetic portion comprising an end surface and a facing end surface; and a female member comprising first and second plates, the first and second plates defining an opening between them for permitting the magnetic portion of the male member to be inserted therethrough, wherein one of the first and second plates is a locking plate and comprises first and second end surfaces and a recessed surface between the end surfaces, such that when the magnetic portion of the male member is inserted through the first opening, the recessed surface and the end surfaces of the locking plate are attracted to the facing end surface of the magnetic portion of the male member, to thereby magnetically and mechanically fasten the male member to the female member.

BRIEF DESCRIPTION OF THE DRAWINGS

A more complete appreciation of the invention any many of the attendant advantages thereof will be readily obtained as the same becomes better understood by reference to the following detailed description when considered in connection with the accompanying drawings, wherein:

FIG. 1 illustrates a first embodiment of the magnetic slide lock assembly of the present invention;

FIG. 2 illustrates a further view of the magnetic slide lock assembly of FIG. 1;

FIG. 13*a* illustrates a fourth embodiment of the magnetic slide lock assembly of the present invention;

FIGS. 13*b* and 13*c* illustrate further embodiments of the slide plates which can be utilized in the slide lock assembly of FIG. 13*a;*

FIG. 14 is cross-sectional view of the magnetic portion of the male member.

DESCRIPTION OF THE PREFERRED EMBODIMENTS

Figure 3A:
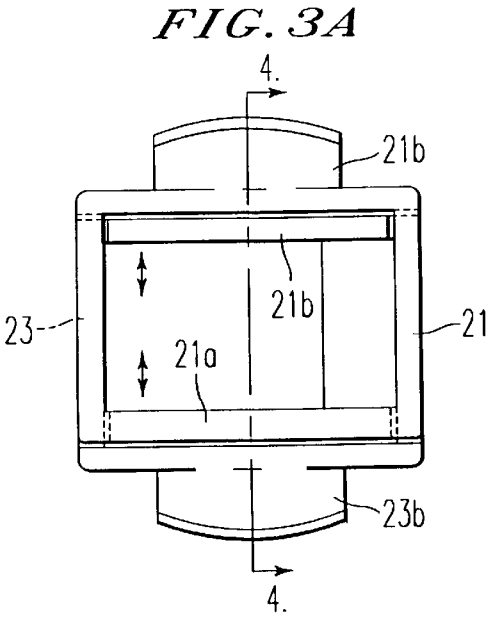
FIG. 3*a* illustrate the overlapping plates of the slide lock assembly of FIG. 1.

Referring now to the drawings, wherein like reference numerals designate identical or corresponding parts throughout the several views, the magnetic slide lock assembly of the present invention utilizes interconnecting male and female members with the female member having a sliding or pivoting component. FIG. 1 illustrates a first embodiment of the magnetic slide lock assembly of the present invention. As illustrated in FIG. 1, the magnetic slide lock assembly comprises a male member 1 having a protruding member or housing 3 and a magnet 5 positioned within the protruding member 3. The protruding member 3 comprises an opening 7 so as to permit a portion of the magnet 5 to be exposed at the opening 7. The male member 1 further includes prongs 9 which can be attached to an article.

The slide lock assembly also includes a female member 11 which can include an aperture 15 for permitting the insertion of the male member 1. The female member 11 further includes first and second housings 17, 19 (FIG. 2). In the housings 17, 19 of the female member, openings are designed so as to permit the insertion of first and second sliding plates 21, 23. The first and second sliding plates 21, 23 are slidably positioned within the female member 11 such that when the male member 1 is inserted into the aperture 15 of the female member, magnetically attracting facing surfaces 21*a*, 23*a* on each of the sliding plates 21, 23 are magnetically attracted through the opening 7 in the protruding member 3 to the exposed portion of the magnet 5. This causes the male member 1 to be magnetically and mechanically engaged to the female member 11.

When it is desired to unlock the male member from the female member, handles 21*b*, 23*b* on each of the respective sliding plates 21, 23 are pressed towards each other so as to move the magnetically attracting facing surfaces 21*a*, 23*a* away from each other as illustrated in FIGS. 1 and 3*a*. That is, movement of the handle 21*b* in a direction toward the magnet 5 will cause the magnetically attracting facing surface 21*a* of the plate 21 to move away from the magnet 5 and outside of the opening 7, while movement of the handle 23*b* in a direction toward the magnet 5 will cause the magnetically attracting facing surface 23*a* of the plate 23 to move out of the opening 7 and away from the magnet 5. This will accordingly permit the protruding member 3 and magnet 5 to be removed from the aperture 15 of the female member 11 and thereby permit the male member 1 to be unlocked from the female member 11.

Figure 3B:
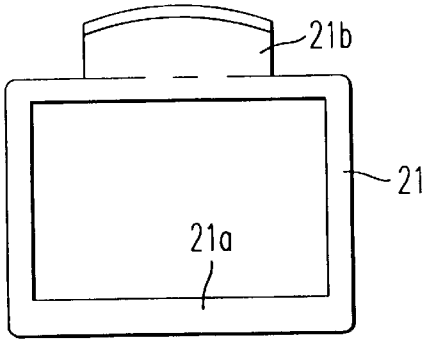
FIG. 3*b* illustrates a top view of one of the plates of FIG. 3*a;*
Figure 3C:
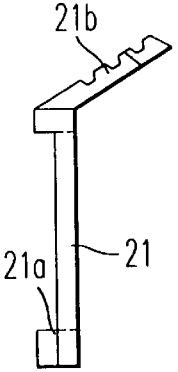
FIG. 3*c* shows a side view of one of the plates of FIG. 3*a;*
Figure 3D:
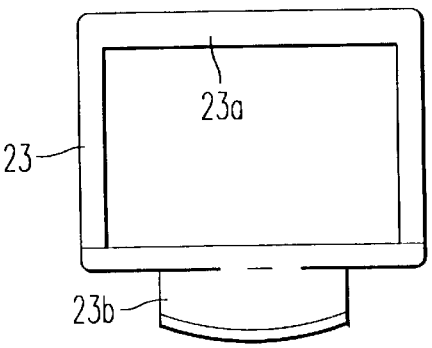
FIG. 3*d* illustrates a top view of the other plate of FIG. 3*a;*
Figure 3E:
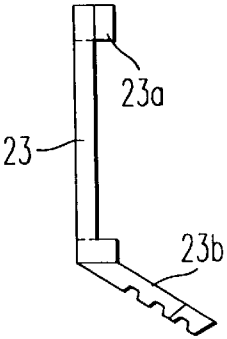
FIG. 3*e* illustrates a side view of the plate of FIG. 3*d;*

FIG. 3*a* illustrates in isolation the overlapping plates 21 and 23. FIG. 3*b* illustrates only the features of the plate 21 while FIG. 3*c* illustrates a side view of the plate 21 illustrated in FIG. 3*b*. FIG. 3*d* illustrates only the plate 23 while FIG. 3e illustrates a side view of the plate illustrated in FIG. 3*d*.

Figure 4:
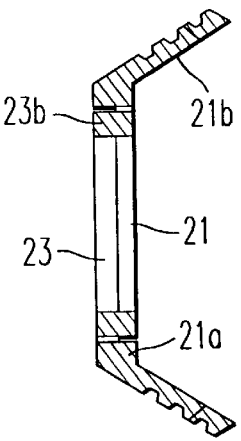
FIG. 4 illustrates a side view of the first and second plates of FIG. 3*a;*

FIG. 4 illustrates a side view of the plates 21 and 23 configured in the overlapping manner illustrated in FIG. 3*a*.

Figure 5:
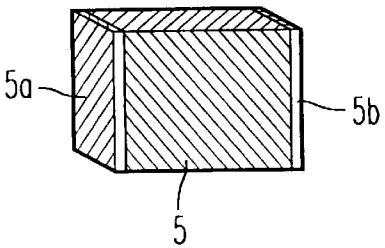
FIG. 5 illustrates a magnet which can be utilized in the slide lock assembly of the embodiment illustrated in FIG. 1.

FIG. 5 illustrates an embodiment of the magnet 5 which can be positioned within the protruding member 3. The magnet 5 can include flux-focusing plates 5*a*, 5*b* which can be ferro-magnetic plates and focus a magnetic flux in a horizontal plane. This enhances the magnetic fastening effect and also prevents magnetic leakage.

Therefore, with the embodiment of FIG. 1–5, during use, the male member 1 can be inserted within the female member 11 as illustrated in FIGS. 1 and 2 so as to cause the sliding plates 21 and 23 to be slid toward the magnet 5 and thereby engage the magnet 5 through the opening 7. When it is desired to unlock the male member 1 from the female member 11, the magnetic plates 21 and 23 can be slid by moving the handles 21*b*, 23*b* toward each other to permit the magnetically attracting faces 21*a*, 23*b* to be separated from the magnet 5. This thereby breaks the magnetic attraction and permits the protruding member 3 to be removed from the aperture 15 of the female member 11.

Figure 6C:
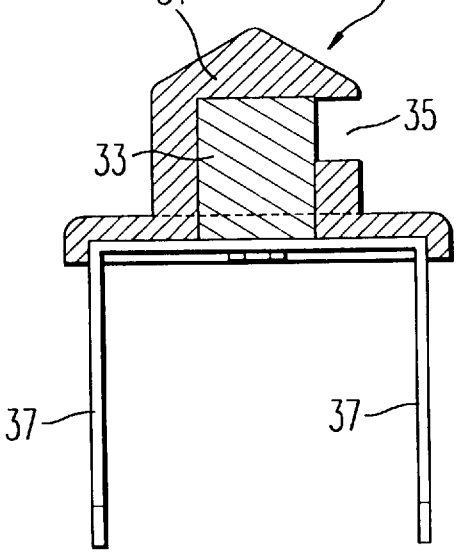
FIG. 6*c* illustrates a third view of the male member of FIG. 6*a;*
Figure 6B:
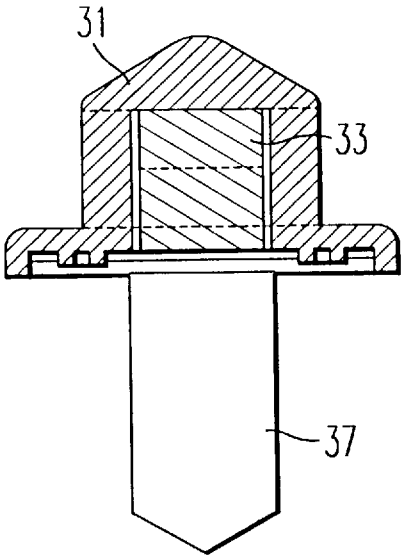
FIG. 6*b* illustrates a second view of the male member of FIG. 6*a;*
Figure 6A:
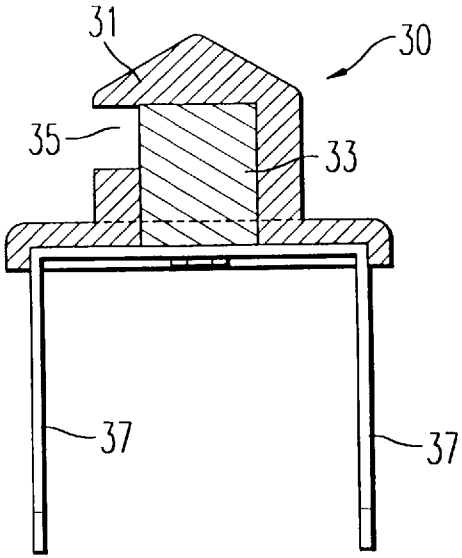
FIG. 6*a* illustrates a first view of a male member which can be utilized in a second embodiment of the slide lock assembly of the present invention.
Figure 7:
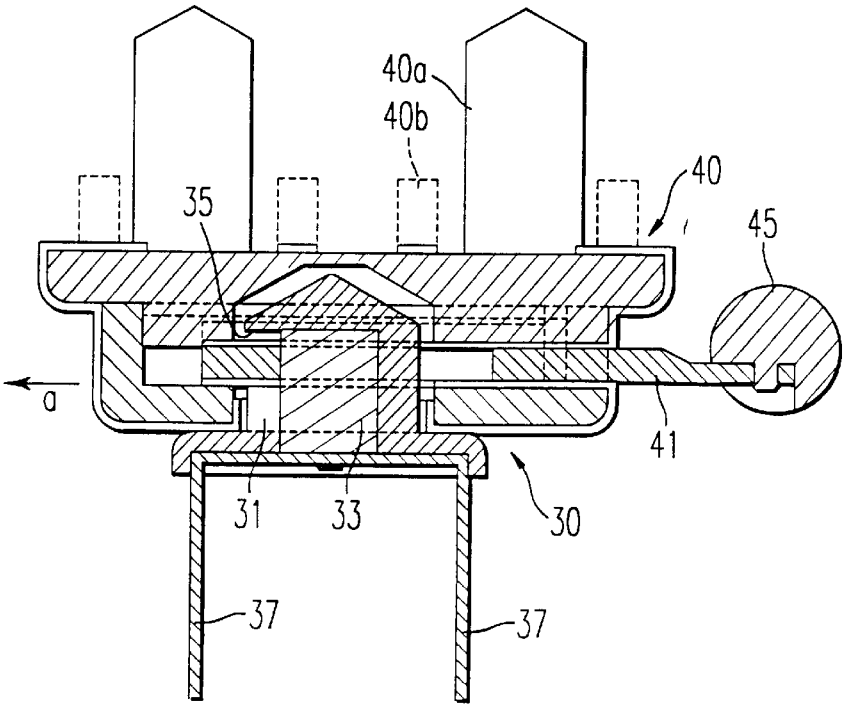
FIG. 7 illustrates a first view of a slide lock assembly of the second embodiment of the present invention.

FIG. 7 illustrates a second embodiment of the magnetic slide lock assembly of the present invention. FIGS. 6*a*, 6*b* and 6*c* illustrate different views of a male member 30 which can be used in the slide like assembly of FIG. 7. As illustrated in FIGS. 6*a*, 6*b* and 6*c* as well as FIGS. 7 and 8, the male member 30 can include a protruding member or housing 31 having positioned therein a magnet 33 in the same manner as that illustrated in FIG. 1. The protruding member 31 includes an opening 35 as illustrated in FIGS. 6*a*, 6*c* and 7. The male member 30 further includes prongs 37 as illustrated in, for example, FIGS. 6*a*, 6*b* and FIGS. 7–8. The prongs are utilized to attach the male 30 member to an article.

Figure 8:
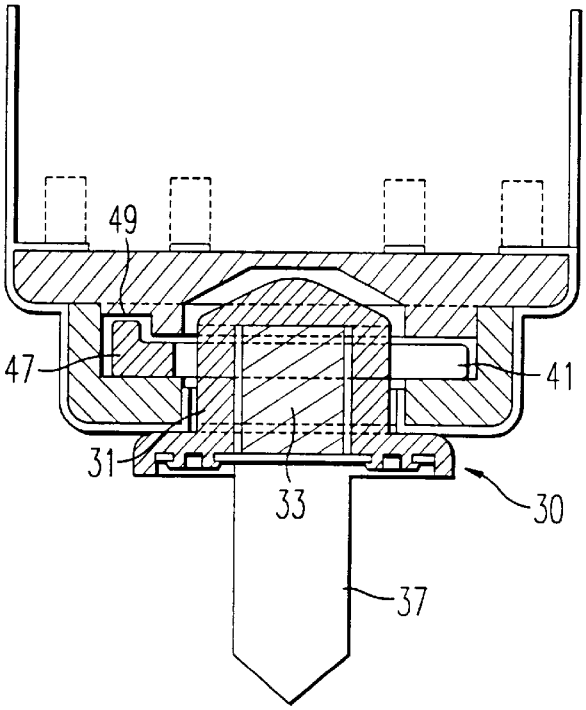
FIG. 8 illustrates a further view of the slide lock assembly of FIG. 7.
Figure 9:
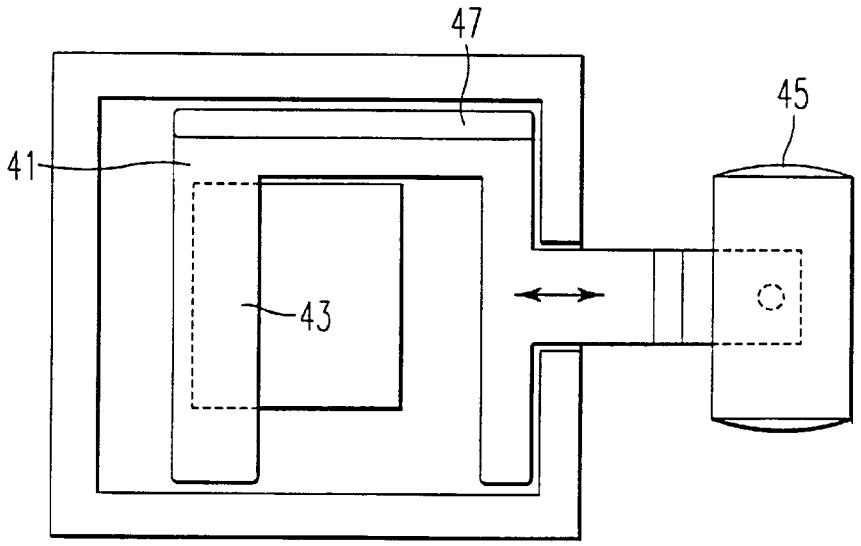
FIG. 9 is a top view illustrating the sliding member of the embodiment of FIG. 7.

FIGS. 7 and 8 illustrate the slide lock assembly with the male member 30 inserted within a female member 40. Female member 40 includes an opening for slidably receiving a sliding member 41. As illustrated in FIG. 9, the sliding member 41 can be substantially C-shaped. The sliding member 41 includes a magnetically attracting surface 43, such that when the male member 30 is inserted within the female member 40 as illustrated in FIGS. 7 and 8, the magnetically attracting surface 43 of the sliding member 41 is attracted to the exposed portion of the magnet 33 through the opening 35 in the protruding member 31. This causes the male member 30 to be magnetically and mechanically fastened to the female member 40.

When it is desired to unlock the male member 30 from the female member 40, the slide plate 41 can be slid in the direction of arrow a (FIG. 7) so as to remove the magnetically attracting surface 43 of the slide plate 41 from the opening 35. This breaks the magnetic attraction between the members 43 and 33 and permits the male member 30 to be removed from the female member 40. The sliding plate 41 can include a knob or handle assembly 45 to facilitate the movement of the sliding plate 41. The sliding plate 41 can also include an upwardly or downwardly extending projecting L-shaped portion 47 which is slidably fitted within a corresponding recess 49 (FIG. 8) of the housing of the female member 40. The example illustrated in FIG. 8 shows the projecting member 47 has a leg upwardly extending into the recess and a leg extending forward male member 30, 49. However, it is recognized that the projecting member 47 can downwardly extend into a corresponding recess in the lower part of the female member 40. The projecting member 47 adds stability to the movement of the C-shaped plate 41 within the locking assembly of the present invention.

As noted in FIGS. 7–9, male member 30 can include prongs 37 while the female member 40 can include locking members 40*a*, 40*b* which can facilitate the attachment of the male and female members 30, 40 to an article.

Figure 10:
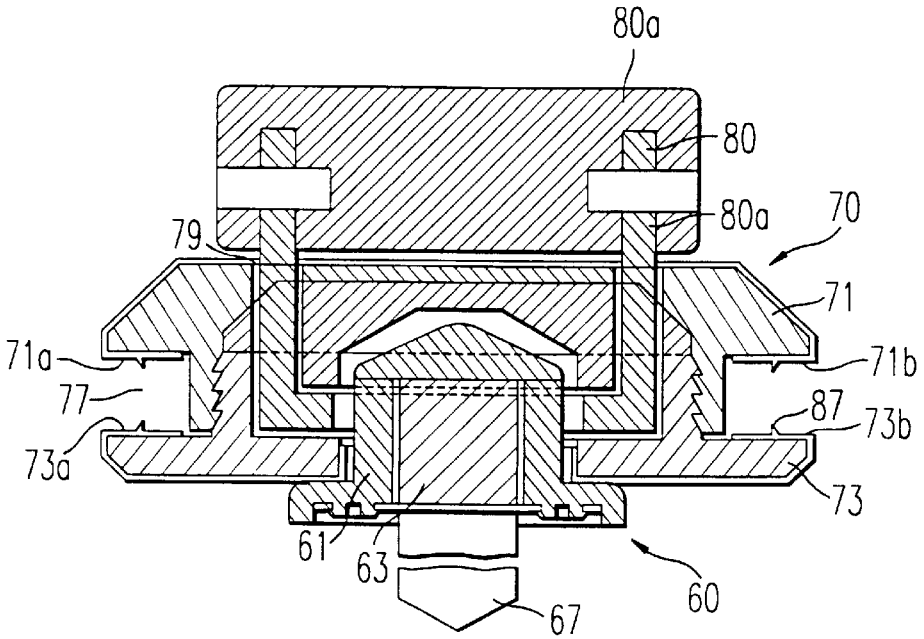
FIG. 10 illustrates a slide lock assembly of a third embodiment of the present invention.
Figure 11:
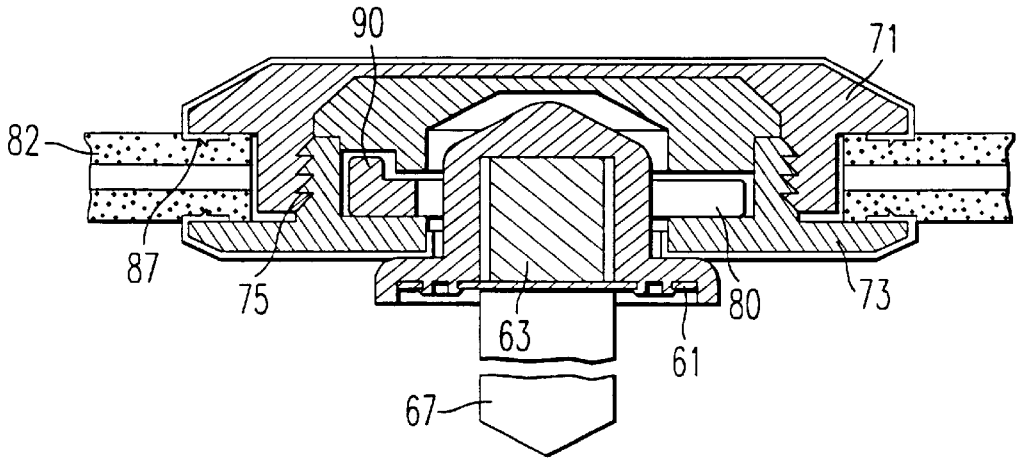
FIG. 11 is a further view of the slide lock assembly of FIG. 10.
Figure 12:
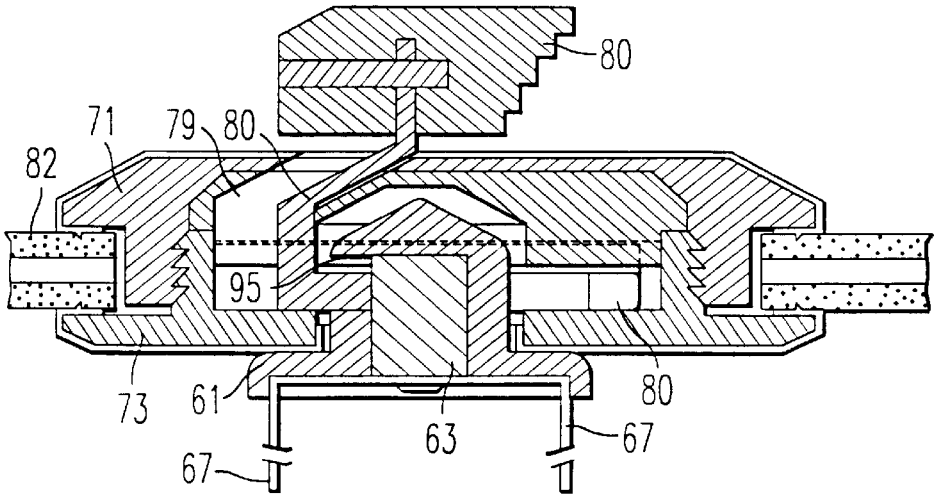
FIG. 12 is a further view of the slide lock device assembly of FIG. 10.

FIGS. 10–12 illustrate a third embodiment of the slide lock assembly of the present invention.

FIG. 10 illustrates a male member 60 having a protruding member or housing 61 in which is positioned a magnet 63. Prongs 67 can be attached to the male member 60. The male member 60 is insertable into an opening of a female member 70 as illustrated in FIGS. 10–12. Female member 70 can include an upper housing 71 and a lower housing 73. The upper housing 71 can be attached to the lower housing 73 by way of lock notches or recesses 75 as illustrated in the drawings. The upper housing 71 can include an overhang portion 71*b* which faces a corresponding portion 73*b* of the lower housing 73. On each of the portions 71*b* and 73*b*, lock notches 87 can be positioned. This facilitates the attachment of the female member 70 to a portion of an article 82 such as illustrated in FIGS. 11 and 12.

The female member 70 of the embodiment of FIGS. 10–12 also includes a recess 79 through which a sliding plate 80 can extend. The sliding plate 80 may be similar to the sliding plate arrangement illustrates in FIGS. 7–9 but includes a handle 80*a* which can upwardly extend through the recess 79 of the female member 70 as illustrated in FIG. 12. In the same manner as the sliding plate arrangement of FIGS. 7–9, the sliding plate 80 includes a projecting member 90 that is slidably fitted in a corresponding recess in the female member 70 as illustrated in FIG. 11. As further illustrated in FIG. 12, upon the insertion of the male member 60 into the female member 70, the attractive force of the exposed portion of the magnet 63 attracts the slide plate 80 to an opening 95 of the protruding member 61 so as to magnetically attract and fasten the male member 60 to the female member 70. Sliding the plate 80 away from the exposed portion of the magnet 63 will permit the male member 60 to be removed from the female member 70 since it will break the magnetic attraction.

A fourth embodiment of the slide lock assembly of the present invention is illustrated in FIGS. 13*a*, 13*b*, 13*c* and 14. As illustrated in FIG. 13A, a sliding component 100 of a female member can include a first sliding plate 101 having a recess 103 which is a locking plate, and a second sliding plate 105 which can be designed based on design constraints to push the sliding plate 101. The sliding plate 101 includes a magnetically attracting surface 103*a* and free end surfaces 103*b* such that when a magnetic portion 107 as illustrated in FIGS. 13A and 14 is inserted through an opening in the casing 109 of the female member, magnetically attracting surface 103*a* of the locking plate 101 is magnetically attracted to a facing surface of the magnetic portion 107. This provides for a strong magnetic and mechanical connection. As noted above, FIG. 14 illustrates a side view of an example of a magnetic portion 107 which can be utilized with the embodiment of the female member illustrated in FIG. 13*a*. When it is desired to disengage the magnetic portion 107 from the element 100, the pusher plate 105 is pushed as indicated by arrow C so as to push the sliding plate 101 away from the magnetic portion 107. The free end surfaces of the pusher plate 105 are movable beneath first and second opposite end flanges of the magnetic portion 107, as can be appreciated from a review of FIG. 13A. This releases the magnetic attraction and mechanical engagement between the magnetic portion 107 and the locking plate 101 and permits the magnetic portion 107 to pass through the opening to cause the disengagement of the magnetic portion 107 from the element 100.

FIGS. 13*b* and 13*c* illustrate further configurations of the sliding plate 101 which can be utilized in the embodiment of FIG. 13*a*. As illustrated in FIG. 13*b*, the sliding plate 101 can include a recessed surface 110, slanted surfaces 110*b* and facing surfaces 110*a*. As illustrated in FIG. 13*c*, the sliding plate 101 can include a curved recess surface 115 positioned between the end surfaces 115*a*. The configuration of the sliding plates as illustrated in FIGS. 13*a*, 13*b* and 13*c* provide for a strong engagement between the sliding plate and the magnetic portion.

Figure 15:
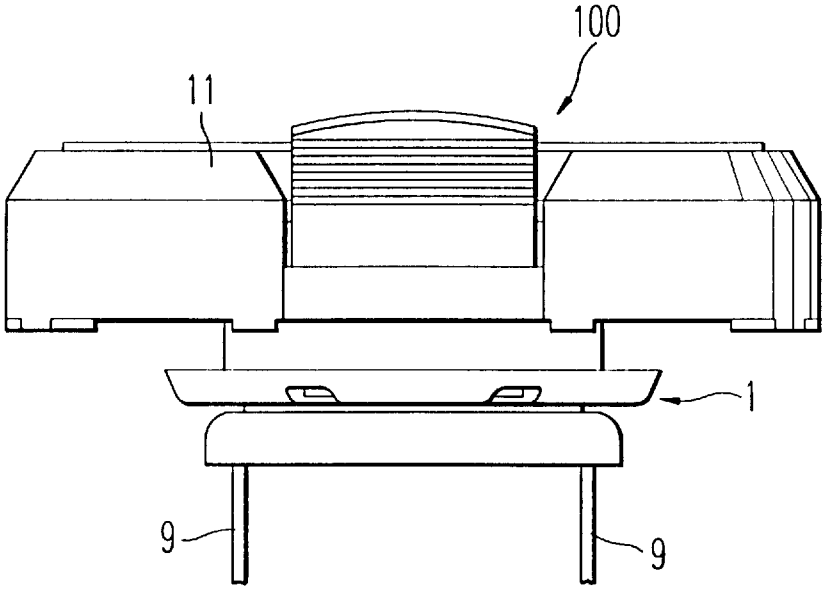
FIG. 15 is an example of a slide lock assembly of the present invention with an ornamental housing or covering.

In all of the described embodiments it is recognized that the components of the slide lock assembly including the female members can be arranged in an ornamental housing or covering 100 as illustrated in, for example, FIG. 15.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A magnetic slide lock assembly comprising:

a male member including a protruding member and a magnet positioned in said protruding member such that a portion of said magnet is exposed through first and second openings in said protruding member; and a female member comprising first and second overlapping plates, such that one of said first and second overlapping plates overlaps over the other of said first and second overlapping plates, said first and second overlapping plates being movable with respect to each other, said first and second overlapping plates being formed so as to define an aperture through the first and second overlapping plates for permitting the protruding member of the male member to be inserted therethrough, said one of said first and second overlapping plates comprising a first magnetically attracting facing surface which downwardly projects from a top surface of said one overlapping plate to a bottom surface of the other overlapping plate, and said other of said first and second overlapping plates comprising a second magnetically attracting facing surface which upwardly projects from the bottom surface of said other overlapping plate to the top surface of said one overlapping plate, such that said first and second magnetically attracting facing surfaces are located in the same horizontal plane, wherein when said protruding member is inserted through said aperture, said first magnetically attracting facing surface is magnetically attracted to one of said first and second openings of the protruding member by said magnet so as to magnetically and mechanically engage with the exposed portion of the magnet through the one opening, and said second magnetically attracting facing surface is magnetically attracted to the other one of said first and second openings of the protruding member by said magnet so as to magnetically and mechanically engage with the exposed portion of the magnet through the other one of the openings, to thereby magnetically and mechanically engage said male member to said female member, and a movement of said first and second overlapping plates so as to space said first and second magnetically attracting surfaces away from said first and second openings of the protruding member reduces the magnetic attraction to permit a removal of the protruding member away form said aperture and magnetically and mechanically disengage said male member and said female member.

2. An assembly according to claim 1, further comprising first and second moving means operationally connected to each of said first and second plates for moving each of said first and second plates with respect to each other to enlarge said aperture and move the first and second magnetically attracting facing surfaces of the first and second plates away from the protruding member to thereby permit said protruding member to pass through said opening.

3. An assembly according to claim 2, wherein (I) said first plate comprises:

(a) a first member having said first moving means connected thereto;

(b) a second member positioned opposite to said first member having a portion which defines said first magnetically attracting facing surface; and (c) third and fourth opposing members interconnecting said first and second members so as to define said aperture; and (II) said second plate comprises:

(a) a fifth member overlapping said second member of said first plate and having second moving means connected thereto;

(b) a sixth member overlapping said first member and having a portion which defines said second magnetically attracting facing surface; and (c) seventh and eighth opposing members which respectively overlap the third and fourth members and interconnect said fifth and sixth members to define said aperture.

4. An assembly according to claim 1, wherein said male member comprises first and second prongs for attachment to an article.

5. An assembly according to claim 1, wherein said female member comprises an ornamental housing.

6. An assembly according to claim 2, wherein each of said first and second moving means comprise upwardly extending portions which extend through slots in said female member.

7. An assembly according to claim 1, wherein two opposite faces of said magnet comprise flux focusing ferro magnetic plates for focusing a magnetic flux in a horizontal plane.

8. A magnetic slide lock assembly comprising:

a male member comprising a protruding member and a magnet having opposite faces and being positioned within said protruding member, said protruding member comprising a first opening for exposing a portion of said magnet; and a female member comprising a housing and a substantially planer sliding member that is slidably mounted within said housing thereby defining a direction of sliding, said sliding member being substantially C-shaped so as to be open on one side thereof and defining a second opening therein which permits passage of the protruding member therethrough, said sliding member comprising a first surface which is attracted to the exposed portion of said magnet through said opening when the male member is inserted into said female member, to thereby magnetically and mechanically engage said male member with said female member, said housing having a recess formed therein which extends in a direction of movement of said sliding member;

wherein said sliding member defines upper planar second surface having an edge bent substantially perpendicular to the plane of the sliding member thereby defining an L-shaped cross section having a projecting member, the projecting member extending along the direction of sliding, said projecting member extending into said recess formed in the housing of said female member and stabilizing movement of said sliding member within said housing, said projecting member being located opposite the open side of said sliding member.

9. An assembly according to claim 8, further comprising a handle for moving the sliding member.

10. An assembly according to claim 8, wherein said male member comprises first and second prongs for attachment to an article.

11. An assembly according to claim 8, wherein said female member comprises an ornamental housing.

12. An assembly according to claim 8, wherein at least one of said opposite faces of said magnet comprises flux-focusing ferromagnetic plates for focusing a magnetic flux in a horizontal plane.

13. A magnetic slide lock assembly comprising:

a male member having a protruding member and a magnet positioned within said protruding member, said protruding member having an opening so as to expose a portion of said magnet, and a female member comprising an upper housing and a lower housing, an outer portion of said upper housing and a facing outer portion of said lower housing, defining an opening therebetween which is sized to permit a portion of an article to be inserted and attached therein;

wherein:

said female member further comprises a substantially planer sliding member that is slidably mounted within said female member thereby defining a direction of movement and having a magnetically attracting surface which engages with the exposed portion of the magnet through the opening of the protruding member when the male member is inserted into an aperture in the female member to magnetically and mechanically engage said male member with said female member, said sliding member being C-shaped and having an open end on one side thereof; and said sliding member comprises a handle member which extends through corresponding slots in the upper and lower housing of the female member, said sliding member defining a substantially planer surface having one edge bent substantially perpendicular to the plane of the sliding member thereby defining an L-shaped cross-section, thereby defining a projection member, said projecting member extending into a recess formed in the female member, said recess extending in the direction of movement of said sliding member and stabilizing movement of the sliding member, and wherein a first leg portion of said L-shaped member extends towards the recess in the female member and a second leg portion thereof extends towards said male member.

14. An assembly according to claim 13, wherein said lower housing comprises locking teeth or recesses which cooperate with locking teeth or recesses on said upper housing.

15. An assembly according to claim 13, wherein the outer portions of each of said upper and lower housings comprise teeth for gripping an article positioned in the opening defined between the outer portion of the upper housing and the outer portion of the lower housing.

16. A magnetic slide lock assembly comprising:

a first member comprising a protruding member, said protruding member comprising a first opening; and a second member comprising a housing and a substantially planer, C-shaped sliding member that is slidably mounted within said housing thereby defining a direction of movement, said sliding member defining a second opening therein which permits passage of the protruding member therethrough and said housing having a recess formed therein which extends in said direction of movement of said sliding member;

a magnet positioned on said first member to thereby magnetically and mechanically engage said first member with said second member;

wherein said sliding member defines a planer second surface with an edge opposite to the second opening of the C-shape that is bent substantially perpendicular to the plane of the sliding member thereby forming an L-shaped cross-section and thereby defining a projecting member, said projecting member extending into a corresponding recess formed in the housing of said second member, the recess extending in the direction of movement, whereby coaction of the bent edge and recess stabilize movement of said sliding member within said housing.

17. A magnetic slide lock assembly comprising:

first member having a protruding member; and a second member comprising an upper housing and a lower housing, an outer portion of said upper housing and a facing outer portion of said lower housing defining an opening therebetween which is sized to permit a portion of an article to be inserted and attached therein;

a magnet positioned on said first member, wherein:

said second member further comprises a sliding member that is slidably mounted within said second member thereby defining a direction of movement, said sliding member being C-shaped so as to form an opening and comprising a handle member which extends through corresponding slots in the upper and lower housing of the second member, said sliding member defining a substantially planer surface having one edge bent substantially perpendicular to the plane of the sliding member thereby defining L-shaped cross-section the bent edge extending in the direction of movement to form a projecting member that extends along a length of the sliding member, said projecting member extending into a recess into the second member which extends in a direction of movement of said sliding member, said recess stabilizing movement of the sliding member, a first leg of said L-shaped member extends into the recess in said second member, is located opposite the opening in the sliding member and wherein a second leg of said L-shaped member extends towards said first member.

* * * * *